US006888152B2

(12) United States Patent
Strickland

(10) Patent No.: US 6,888,152 B2
(45) Date of Patent: May 3, 2005

(54) IR SOURCE, METHOD AND APPARATUS

(75) Inventor: Theodore R. Strickland, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 0 days.

(21) Appl. No.: 10/331,792

(22) Filed: Dec. 30, 2002

(65) Prior Publication Data

US 2003/0141463 A1 Jul. 31, 2003

Related U.S. Application Data

(62) Division of application No. 09/738,823, filed on Dec. 15, 2000, now Pat. No. 6,521,904.

(51) Int. Cl.[7] ..... G21G 60/299

(52) U.S. Cl. ..... 250/495.1; 250/203.2

(58) Field of Search ..... 250/493.1, 203.2, 250/495.1, 496.1, 497.1, 203.1, 203.3; 244/3, 16, 12, 1

(56) References Cited

U.S. PATENT DOCUMENTS 3,938,386 A * 2/1976 Comfort et al. ..... 374/107
5,424,741 A * 6/1995 Genovese ..... 342/10
5,679,921 A * 10/1997 Hahn et al. ..... 149/19.3
6,427,599 B1 * 8/2002 Posson et al. ..... 102/336

* cited by examiner

*Primary Examiner*—David V. Bruce
*Assistant Examiner*—Hoon Song
(74) *Attorney, Agent, or Firm*—Robert L. Rispoli

(57) ABSTRACT

The invention is an apparatus for producing an IR (infra-red) signature. In the method, the apparatus is mounted on a target to give the target an infra-red signature whereby the target can be acquired by an appropriate weapon sensor.

4 Claims, 3 Drawing Sheets

IR SOURCE, METHOD AND APPARATUS

CROSS-REFERENCE TO OTHER APPLICATIONS

This application is a divisional application of Ser. No. 09/738,823 filed Dec. 15, 2000 now U.S. Pat. No. 6,521,904, entitled "IR Source, Method and Apparatus" the entire disclosure of which is incorporated herein by reference.

This invention relates to an IR (infra-red) source, and more particularly to a structure of an IR source to be used on targets to allow the siting of weapons having appropriate sensors on the target.

BRIEF SUMMARY OF THE INVENTION

Figure 1:
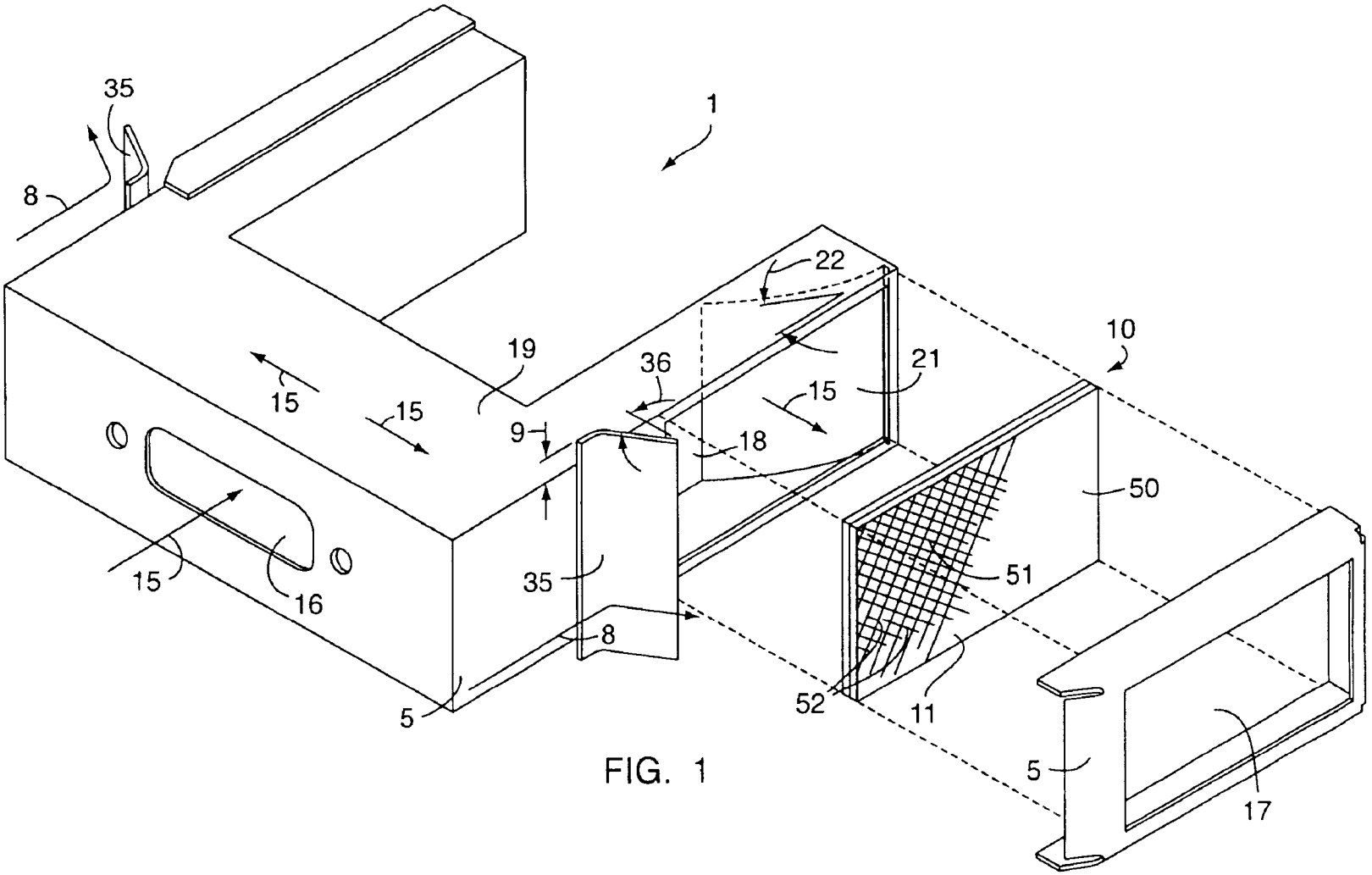
FIG. 1 shows an exploded view of the apparatus.

An overview of the apparatus of the present invention is depicted in FIG. 1. The IR source 1 is comprised of a catalytic assembly 10, which radiates when contacted by a first fluid 15, positioned within an exit 17 of a housing 5. Housing 5 is depicted in two parts to more clearly show that catalytic assembly 10 is positioned within exit 17 of housing 5. It should further be understood that there can be multiple exits 17 each with a catalytic assembly 10 positioned therein.

The catalytic assembly 10 is comprised an element 50 with a catalyst 51 positioned thereon. The catalytic assembly 10 can be made from a single element or a plurality of elements.

The entrance 16 of housing 5 is adapted to be connected to the source of first fluid 15, in this case the exhaust port of an internal combustion engine. The first fluid 15 enters the housing through entrance 16 and is directed through catalyst assembly 10 then out exit 17.

The housing 5 comprises an exterior surface 19 with a partition 35 extending outwardly therefrom. The partition 35 is positioned such that a second fluid 8 flowing toward the downstream face 11 of catalytic assembly 10 will be deflected away from the downstream face 11.

Within housing 5, baffle 21 is positioned outwardly from the interior surface 18 to direct the first fluid 15 flow toward catalytic assembly 10.

Figure 2:
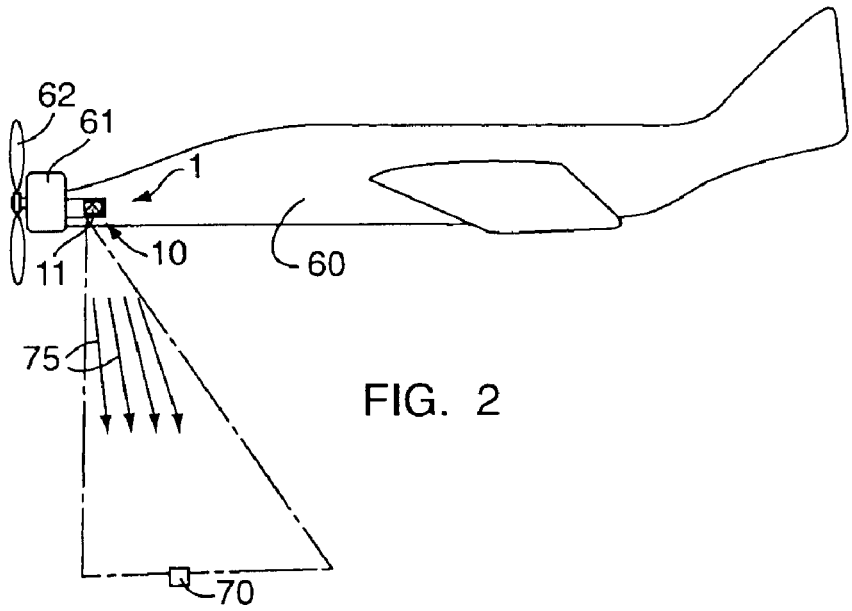
FIG. 2 shows a side view of a target, in this case a drone aircraft, with the apparatus mounted thereon.

FIG. 2 shows the apparatus of FIG. 1 mounted on a target 60, in this case an aerial drone. The apparatus is connected to an engine 61 such that the first fluid 15, in this case the exhaust from the engine, causes the catalytic assembly to radiate. Catalytic assembly 10 is positioned in the exit 17 such that the generated radiation 75 is visible to a distant observer 70. FIG. 2 also shows that the engine 61 is integrated into the propulsion system, attached to a propeller 62, of the target 60.

Figure 3:
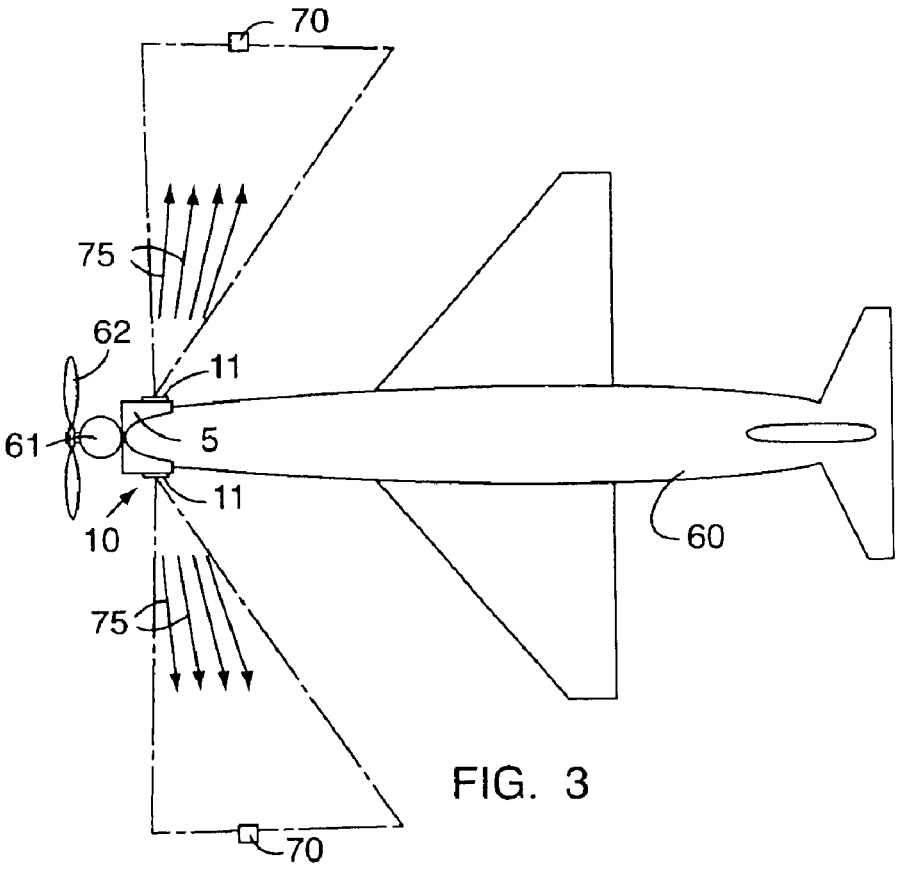
FIG. 3 shows a top view of the target depicted in FIG. 2.

FIG. 3 shows another view of target 60 to illustrate that multiple catalytic assemblies 10 can be employed.

Figure 4:
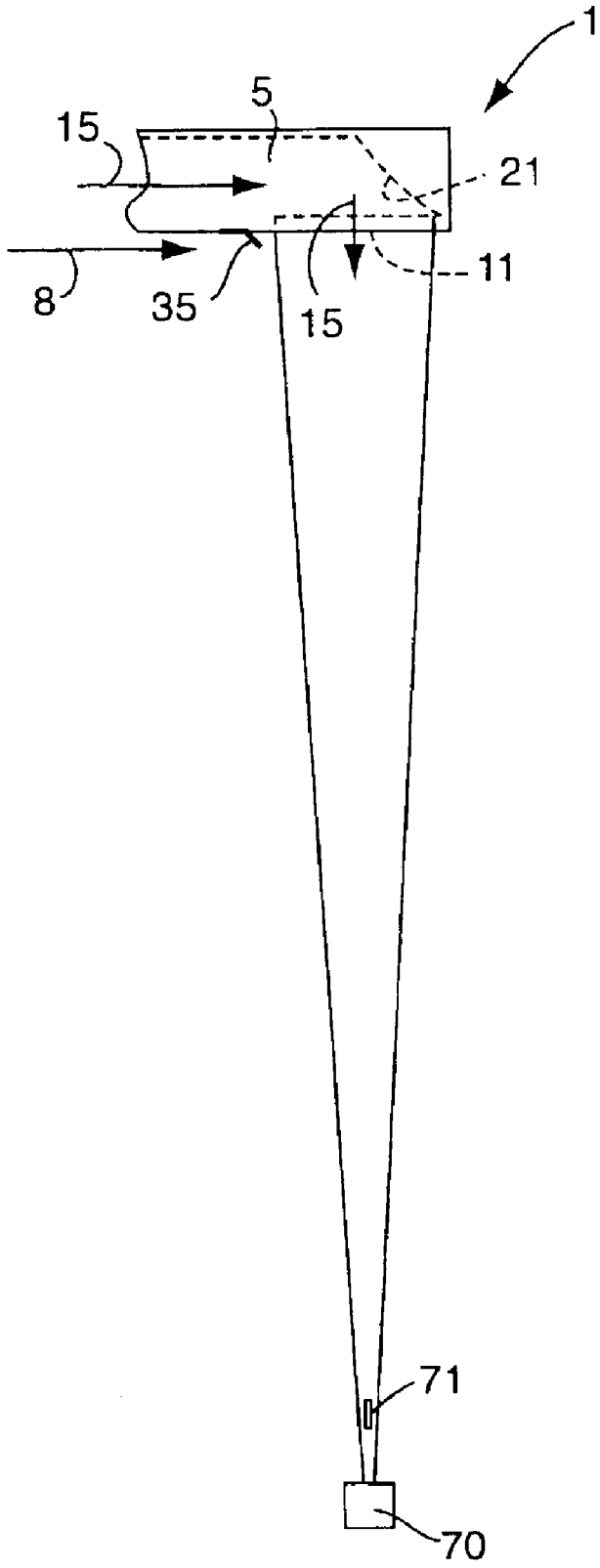
FIG. 4 shows a view of what an observer perceives from the IR source.

FIG. 4 shows a schematic representation from the distant observer's perspective. The device is intended as an IR source that can be acquired by a sensor that is part of a weapon (not shown). The sensor is manipulated by the distant observer 70. Thus an irradiance 71 at the location of the sensor, assumed to the distant observer 70, must be sufficient for the sensor to detect.

DETAILED DESCRIPTION

The catalytic assembly 10 is comprised of at least one element 50 with a catalyst 51 positioned thereon. As those skilled in the art will recognize, there are numerous structures for element 50 as well as numerous catalyst for catalyst 51 and still further numerous ways of positioning the catalyst on the element. Element 50 must be capable of radiating, elements providing greater emissivity are preferred. In the case of the present invention, a metallic, short channel element, woven metal 10×10 mesh constructed of Haynes 230, was used. Other element structures such as expanded metal, gauze, foam, or monolith constructed of almost any material including metals or ceramics could be used.

It is preferred that the shape of the material chosen for element 50, or most downstream element 50 in the case where multiple elements 50 are employed, provide a radiation pattern off the downstream face 11 in more than a single direction. An element 50 is comprised of members 52, in this case wire woven into a mesh. Wire has a round cross-section that generates a hemispherical radiating pattern off the downstream face 11. If the shape of the members at the downstream face were planar, a typical monolith, the members 52 would generate a radiation pattern in a single direction. It would be possible, however, to use members 52 with cooperating planer surfaces to generate a multi-directional radiation pattern. For example, two planar surfaces oriented at an acute angle to one another.

Depending upon the element chosen and the application, a single or multiple element catalytic assembly might be devised. The most downstream surface of the most downstream element 50, based on the flow of the first fluid through the catalyst assembly, is defined as the downstream face 11. In the case of a multiple element 50 catalytic assembly, it is preferred that the members 52 of respective elements 50 be offset to one another relative to the flow of the first fluid 15 through the catalytic assembly.

The catalyst 51 is application dependent, depending upon the composition and operating conditions of the first fluid 15 in combination with the weapon sensor and the range on which the target will be used. The catalyst must be positioned on the element, or elements, such that the catalytic assembly 10 when contacted with the first fluid 15 radiates. Positioning could be accomplished through any number of commonly used deposition techniques or integrated into the composition of the element. In the case of the present embodiment wherein the first fluid 15 is the exhaust gas of an internal combustion engine, any precious metal catalyst, such as platinum or palladium, could be used.

While this embodiment depicts the first fluid 15 as an exhaust gas of an internal combustion engine, this should not be considered a limitation of the invention. It is preferred that the invention utilizes a first fluid 15 that is presently available onboard the target, the exhaust gas or a fuel. The present invention, however, will function as intended if the first fluid is ancillary to the target, for example a bottled fuel. In addition, it is anticipated that other engines, other than internal combustion, may be used to generate the second fuel 15.

The housing 5 is the structure that holds the catalytic assembly 10 in the housing's exit 17. The design of exit 17 is application dependent, but it is preferred that the opening be sized to permit the maximum exposure of the catalytic assembly 10 downstream face 11 to a distant observer. It should be realized, that the housing can be adapted to the first fluid source with multiple entrances 16. The material selected for the housing is application dependent.

A partition 35 extends outwardly from the housing 5 exterior surface 19. Where the target is moving, such as in the depicted aerial drone, the catalyst assembly 10 could be cooled by a second fluid 8 passing over the surface. It is preferred that the partition 35 be located upstream of the downstream face 11, relevant to the flow of fluid 8, to prevent as much as possible this cooling effect, in the presented embodiment thereby defining a partition angle 36 that is acute. The partition 35 also has an overhang 9 that extends beyond the width of the downstream face 11 to account for non-parallel second fluid 8 flow patterns.

When the housing 5 is adapted to be in fluid communication with the source of the first fluid, the passage created by the housing may have turns. In order to assure maximum utilization of the catalyst 51, it is preferred that the first fluid be distributed equally throughout the catalyst assembly 10. In the present embodiment, baffle 21 extends outwardly from the interior surface 18 of housing 5 to accomplish this objective. When baffle 21 is performing this function, as depicted in this embodiment, it is preferred that the baffle in cooperation with the downstream face define a baffle angle 22 that is acute. Baffle 21, however, might be employed to simply reduce the pressure drop between entrance 16 and exit 17. The shape and positioning of the baffle is based on the application, but in the preferred embodiment that baffle was given a fair surface and the surface was given a parabolic shape.

In the method of the present invention, the catalytic assembly 10 is engineered such that the catalyst 51 cooperates with the first fluid 15 to create a radiation 75. The amount of radiation 75 required is dependent upon the sensor being used and the parameters of the range such as distance from sensor, which is illustrated herein as the distance from observer 70 to the target. The first fluid can either by a fluid onboard the target, exhaust gas or fuel, or from an ancillary source added to the target. To provide additional benefit to the observer by illuminating the target from multiple perspectives, multiple exits 17 each with a catalyst assembly 10 can be positioned at different locations on the target.

What is claimed is:

1. The method of using a catalyst assembly as an IR source for a target comprising:

oxidizing a first fluid by passing the first fluid through a catalytic assembly causing the element to radiate, and exposing the radiation to an observer positioned a distance from the element whereby the observer can site a weapon on the element.

2. The method of claim 1 further including the step of generating an exhaust gas and the first fluid is the exhaust gas.

3. The method of claim 1 wherein there are at least two catalyst assemblies.

4. The method of claim 3 wherein the catalyst assemblies are positioned on the target drone to provide a target on at least two sides of the target drone.

* * * * *